US006583779B1

(12) United States Patent
Ushirono

(10) Patent No.: US 6,583,779 B1
(45) Date of Patent: Jun. 24, 2003

(54) DISPLAY DEVICE AND DRIVE METHOD THEREOF

(75) Inventor: Junichi Ushirono, Kagoshima (JP)

(73) Assignee: Sony Corporation, Tokyo (JP)

( * ) Notice: Subject to any disclaimer, the term of this patent is extended or adjusted under 35 U.S.C. 154(b) by 207 days.

(21) Appl. No.: 09/584,141

(22) Filed: May 31, 2000

(30) Foreign Application Priority Data

Jun. 2, 1999 (JP) ..... 11-154718
Apr. 21, 2000 (JP) ..... 2000-120744

(51) Int. Cl.[7] ..... G09G 3/36

(52) U.S. Cl. ..... 345/100; 345/87; 345/92; 345/93; 345/98; 345/99

(58) Field of Search ..... 345/98, 99, 100, 345/87, 92, 93

(56) References Cited

U.S. PATENT DOCUMENTS 5,515,072 A * 5/1996 Yanai et al. ..... 345/92
5,748,175 A * 5/1998 Shimada et al. ..... 345/127
6,128,045 A * 10/2000 Anai ..... 348/556

* cited by examiner

*Primary Examiner*—Richard Hjerpe
*Assistant Examiner*—Jean Lesperance

(57) ABSTRACT

Displaying an image at different aspect ratios requires incorporating circuits such as memory and scan converters into the drive system driving the display thus increasing the cost. In an active matrix liquid crystal display device a logic control circuit is added to the vertical drive circuit, and when a black display pulse BLK for switching the aspect ratio is applied, the pixels in a specified range at the top and bottom (or left and right) of the pixel section are set to active status and, a black level signal written for all pixels of the area set to active status and, pixels of all other areas are set by line to active status in sequence in the pixel section by vertical scanning performed by a vertical scanner and display signals are written for each line by horizontal scanning with a horizontal scanner, to allow displaying different aspect ratios with a simple design, low cost and low power consumption.

24 Claims, 4 Drawing Sheets

DISPLAY DEVICE AND DRIVE METHOD THEREOF

BACKGROUND OF THE INVENTION

1. Field of the Invention

The present invention relates to a display device and drive method thereof and relates in particular to a display device and drive method capable of displaying different aspect ratios.

2. Description of Related Art

In recent years, so-called wide vision (high vision) having an aspect ratio of 16:9 has been developed, as compared to the standard aspect ratio of 4:3 for television (NTSC method, etc.). Video camera equipment is also being developed having a high filming mode for wide vision. The development of wide vision has increased the demand for display devices having a screen aspect ratio of 4:3 for standard television systems to also have wide vision display capability with an aspect ratio of 16:9.

Wide vision requires a display with a large screen. Panel displays such as electroluminescence display devices (EL) and liquid crystal displays (LCD) not requiring much space are ideal for use as large screen displays. A feature of these liquid crystal display devices is that theoretically little drive power is required thus allowing utilization such as in electrical view finders (EVF) in video camera equipment.

However, the aspect ratio must be switched according to the television system being used so that the display device is compatible with television systems having different aspect ratios. Therefore, in the liquid crystal display device disclosed for instance in Japanese Patent Laid-open No. 5-199482, in the effective display area with pixels arrayed in lines, the voltage potential of the scanning electrode for a specified number of pixels at the top and bottom edges of that display area was made to equal the voltage potential of the signal electrode. In the liquid crystal display device disclosed for instance in Japanese Patent Laid-open No. 8-314421, processing was performed to write black color information in a specified number of scanning lines at the top and bottom edges of the effective display area.

However, in either of these examples of the related art, circuits such as memories or scan converters were required in the drive system to drive the display for displaying different aspect ratios, causing the problem of the additional costs required for those circuits. A liquid crystal display device such as utilized in EVF of video camera equipment, having a simple design and low power consumption, was therefore demanded, capable of displaying different aspect ratios, and with as low a cost and simple a structure as possible.

SUMMARY OF THE INVENTION

In view of the above mentioned problems with the conventional art, this invention has the object of providing a display device and drive method thereof, with a simple design, low cost, low power consumption, and capable of displaying different aspect ratios.

The display device of this invention is comprised of a pixel section containing pixels arrayed in lines, a vertical drive system to sequentially set each pixel of that pixel section to active status a line at a time, a control circuit to set the pixels of a specified area on the upper and lower or right and left of the pixel section to active status when a control signal is applied, and a horizontal drive system to write a specified luminance level signal for all pixels of an area set in active status by this control circuit, and also write for pixels of all other areas, display signals in each line sequentially set to active status by the horizontal drive circuit.

In the display device of this configuration, the control circuit sets each pixel of a specified area of the upper and lower (or left and right) of the pixel section to active status regardless of vertical scanning by the vertical drive system, when a control signal is applied for switching the aspect ratio for instance from 4:3 display screen to a 16:9 display screen. The horizontal drive system supplies a specified luminance level signal to the pixel section at this time. A specified luminance level signal is thus written in all pixels of a specified area of the upper and lower (or left/right of pixel section) of the pixel section. In areas other than the specified area however, along with making each pixel active a line at a time sequentially by vertical scanning in the vertical scanning system, a display signal is written in each line by horizontal scanning of the horizontal drive system.

DETAILED DESCRIPTION OF THE PREFERRED EMBODIMENTS

Figure 1:
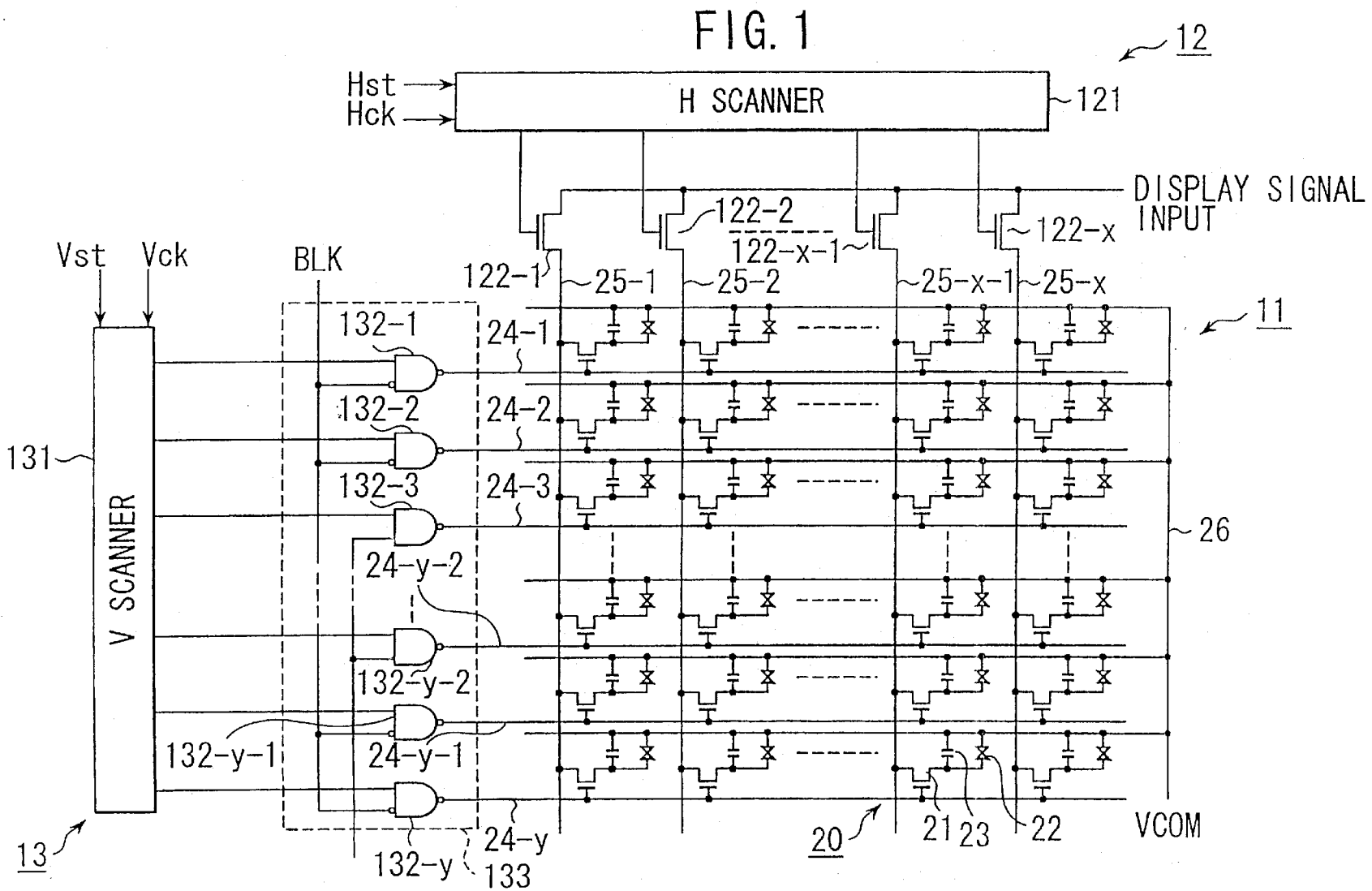
FIG. 1 is a concept diagram showing a typical structure of the active matrix liquid crystal display device of the first embodiment of this invention.

A detailed description of the preferred embodiments of this invention is next related while referring to the accompanying drawings. FIG. 1 is a concept diagram showing a typical structure of the active matrix liquid crystal display device of the first embodiment of this invention. In FIG. 1, the active matrix liquid crystal display device of the first embodiment is comprised of a pixel section (effective pixel area) 11 containing pixels arrayed in lines (matrix), a horizontal (H) drive system 12 positioned for example above the pixel section 11 for writing display data into each pixel in dot sequence, and a vertical (V) drive system 13 installed for example on the left side of the pixel section 11 for selecting a line of pixels.

The pixel section 11 is fabricated by sealing liquid crystal material between two transparent insulating substrates (for example, glass substrates). Each pixel 20 arranged in lines in the pixel section 20, is comprised of a polysilicon TFT (thin film transistor) 21 as a switching device, a liquid crystal cell 22 with a pixel electrode connected to the drain electrode of the TFT 21, and an auxiliary capacitor 23 with one electrode connected to the drain electrode of the TFT21.

The TFT 21 gate electrodes for instance of polysilicon of each pixel 20 are connected to respective gate lines 24-1,

24-2 . . . , 24-y-1, 24-y for y lines corresponding to the number of pixels Y (hereafter vertical pixel number Y) in the vertical (direction of lines) direction. The TFT source electrodes for instance of aluminum are connected to respective gate lines 25-1, 25-2 . . . , 25-x-1, 25-x for x lines corresponding to the number of pixels X (hereafter horizontal pixel number X) in the horizontal (column direction) direction. Further, in the liquid crystal cell 22, the opposing electrodes made for instance from ITO and the other electrode for auxiliary capacitors made for instance from polysilicon, are connected to the common line 26 applied with a common voltage VCOM.

The horizontal drive system 12 is comprised of an H scanner 121 made from TFT devices for example comprised of a number of shift register stages corresponding to the horizontal pixel number X, and of x number of horizontal switches 122-1 through 122-n, formed to correspond to the horizontal pixel number X. Transfer pulses for each stage obtained by synchronizing a horizontal start pulse HST with the horizontal clock Hck in sequence, are sent by the H scanner 121 in sequence, as horizontal scan pulses. The horizontal switches 122-1 through 122-n are formed for instance of MOS transistors and turn on in sequence in response to the horizontal scan pulse output in sequence from the H scanner 121, and the display data is supplied to the signal lines 25-1 through 25-n of the pixel section 11.

The vertical drive system 13 comprised for instance of TFT devices, has a structure capable of driving a display for showing a specific color (for instance, black) on the upper and lower portions of the screen when switching the aspect ratio for instance from standard mode for standard television signals with an aspect ratio of 4:3, to wide mode with a wide vision aspect ratio of 16:9. In order to simplify the explanation, the following example describes the case when showing a black color display on a screen with two lines each on the upper and lower portions.

More specifically, the vertical drive system 13 is comprised of a V scanner 131 constituted by a number of shift register stages corresponding to the vertical pixel number Y, and from a logic control circuit 133 constituted by a y number of NAND circuits 132-1 through 132-y formed to correspond to the vertical pixel number Y. The V scanner 131 outputs as vertical scanning pulses, the transfer pulses of each stage obtained by synchronizing the vertical start pulse Vst with the vertical clock Vck and transferring them in sequence. The vertical scanning pulses are designed so that the low level (L level) becomes the active state (active "L") when the vertical scanning pulse is input to the logic control circuit 133.

A vertical scan pulse output from the V scanner 131 is supplied in sequence as one of the inputs to each of the NAND circuits 132-1 through 132-y in the logic control circuit 133. An active "L" pulse upper/lower black color display pulse BLK is then applied to the NAND circuits 132-1, 132-2 corresponding to the upper two lines and to the NAND circuits 132-y-1, 132-y corresponding to the lower two lines of the black color display area of pixel section 11. This upper/lower black color display pulse BLK is a control signal for controlling the aspect ratio switching. A power supply voltage VDD is applied to areas other than the black color display area of pixel section 11, or in other words to the NAND circuits 132-3 through 132-y-2 corresponding to the 3rd line to (y-2) line of the center section of the effective display area.

In the logic control circuit 133, the NAND circuits 132-1, 132-2 corresponding to the upper two line portion, and the NAND circuits 132-y-1, 132-y corresponding to the lower two line portion, implement the black color display when displaying a 16 9 aspect ratio, and form the circuit section (hereafter called black frame display circuit A) for implementing the effective display when displaying a 4:3 aspect ratio. The NAND circuits 132-3, 132-y-2 corresponding to the 3rd line through (y-2) line form the circuit section (hereafter called effective display circuit B) for implementing the constant effective display regardless of the aspect ratio.

Figure 2:
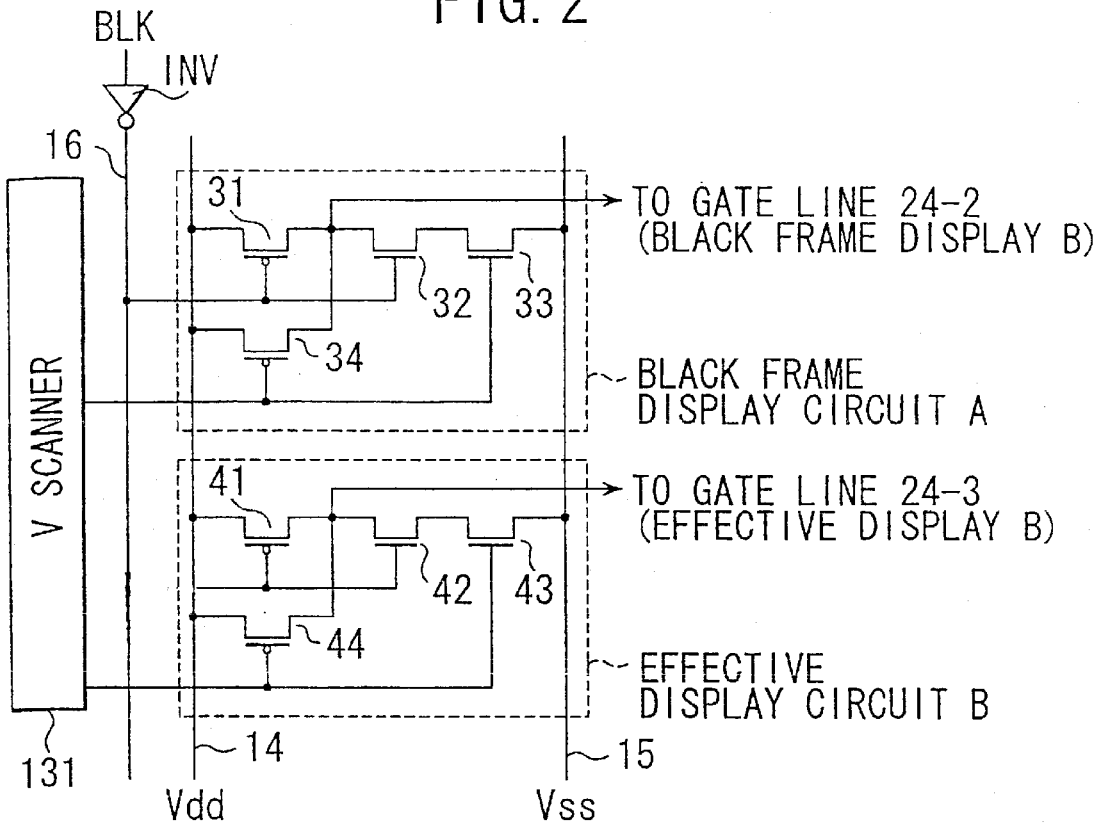
FIG. 2 is a circuit diagram showing the detailed circuit structure of the black frame display circuit A and the effective display circuit B.

FIG. 2 is a circuit diagram showing the detailed circuit structure of the black frame display circuit A (NAND circuits 132-1, 132-2, 132-y-1, 132-y) and the effective display circuit B (NAND circuits 132-y-1, 132-y).

The black frame display circuit A is comprised of p type FET 31, and n type FET 32, 33 connected in series between the negative power supply (Vss) line 15 and the positive power supply (Vdd) line 14, and a p type FET 34 connected in parallel with the p type FET 31. The gate electrodes for the p type FET 31 and the n type FET 32 are jointly connected to a control line 16 and are supplied with an upper/lower black color display pulse BLK by way of the inverter INV. The gate electrodes of the n type FET 33 and P type FET 34 are applied with a 2nd line vertical scanning pulse output from the V scanner 131.

The black frame display circuit B is comprised of p type FET 41, and n type FET 42, 43 connected in series between the negative power supply (Vss) line 15 and the positive power supply (Vdd) line 14, and a p type FET 44 connected in parallel with the p type FET 41. The gate electrodes for the p type FET 41 and the n type FET 42 are jointly connected to a Vdd line 14. The gate electrodes of the n type FET 43 and p type FET 44 are applied with a 3rd line vertical scanning pulse output from the V scanner 131.

The explanation up until now has described a black color display with two lines each on the upper and lower portions of the screen in order to simplify the description. In fact however, with Y as the vertical pixel number Y, and X as the horizontal pixel number X, and the same pixel pitch set in the horizontal and vertical directions, on a screen with an aspect ratio of 4:3, then Y is equal to X·3/4.

To achieve an aspect ratio of 16:9 however, in the control circuit 133, the black frame display circuit A is comprised of corresponding NAND circuits from the first stage to the (1/8·Y) stage, and from the (7/8·Y+1) stage to the final stage in the V scanner 131. The effective display circuit B is comprised of all the other NAND circuits.

As one example, in a pixel array of in pixel section 11 with a horizontal pixel number X=320, and a vertical pixel number Y=240, the black frame display circuit A is comprised of corresponding NAND circuits from the first stage of the V scanner 131 up to stage 30 and, from stage 211 up to the final stage, while the effective display circuit B is comprised of NAND circuits from stage 31 up to stage 210. If the pixel size in the horizontal and vertical directions is different, then the stage numbers as defined above are also different.

Figure 3:
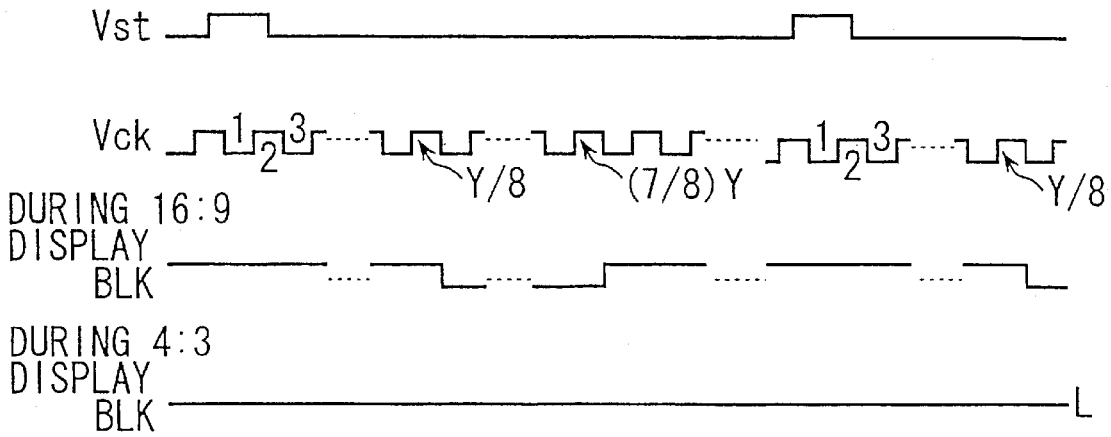
FIG. 3 is a timing chart showing a typical timing relationship of the upper/lower black color display pulse BLK during a 4:3 display and during a 16:9 display for a vertical start pulse Vst and a vertical clock pulse Vck.

FIG. 3 is a timing chart showing a typical timing relationship of the upper/lower black color display pulse BLK during display of a 4:3 aspect and during display of a 16:9 aspect for a vertical start pulse Vst and a vertical clock pulse Vck in the V scanner 131. As the timing chart clearly shows, the timing is set so that the upper/lower black color display pulse BLK is constantly at an "L" level state during display of a 4:3 aspect, and in an "H" level state in the black color display area during display of a 16:9 aspect, and sets to an "L" level in the effective display area.

Next, the respective display operations during a 4:3 aspect display and during a 16:9 aspect display are described for the above configured pixel section 11 (X=320, Y=240).

Figure 4:
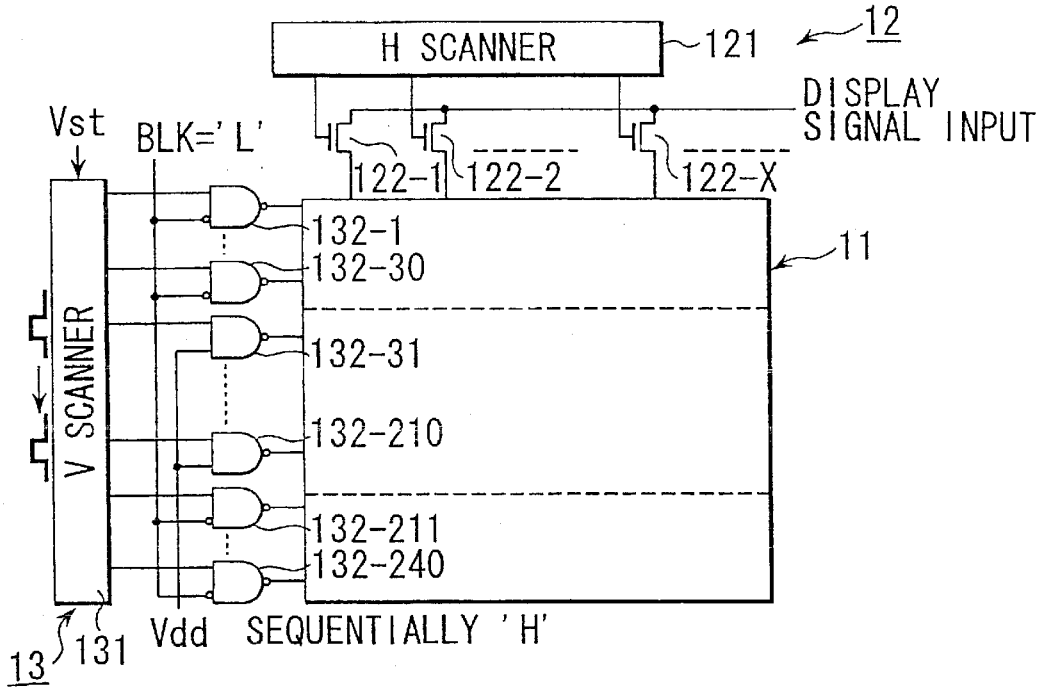
FIG. 4 is a concept diagram illustrating the operation when the aspect ratio is 4:3.

When a 4:3 aspect is displayed, as shown in FIG. 4, the upper/lower black color display pulse BLK always sets to "L", and this state is input (negative input) to one input of the NAND circuits 132-1 through 132-30, 132-211 through 132-240. The power supply voltage Vdd is applied to the other input of the NAND circuits 132-31 through 132-210.

In this state, the active "L" of the vertical scanning pulse sequentially output from the V scanner 131 is supplied to other input of the NAND circuits 132-1 through 132-240, so that the output from NAND circuits 132-1 through 132-240 sequentially set to an "H" level, and each gate line (equivalent to gate lines 24-1 through 24-7 of FIG. 1) of pixel section 11 sets in sequence to active state.

In the horizontal drive system 12 on the other hand, for each line selected in sequence by vertical scanning by the vertical scanning system 13, the horizontal switches 122-1 through 122-x sequentially set to the on state in response to horizontal scanning pulses output in sequence from the H scanner 121, and display data is supplied to signal line 1 (equivalent to signal lines 25-1 through 25-x of FIG. 1) of pixel section 11. As a result, a display image with an aspect ratio of 4:3 is then assembled.

Figure 5:
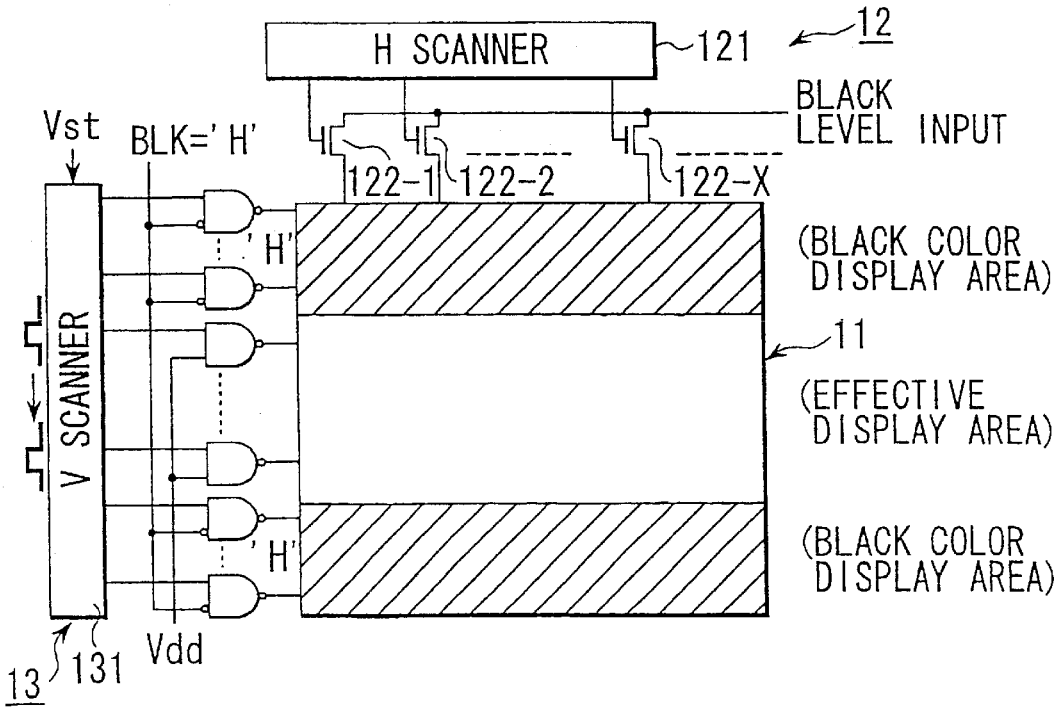
FIG. 5 is a concept diagram illustrating the operation in the black color display area when the display is an aspect ratio 16:9.

Next, during a display with a 16:9 aspect ratio, in the black color display area display period, as shown in FIG. 5, the upper/lower black color display pulse BLK sets to "H" level and this level is input as respective negative inputs in the NAND circuits 132-1 through 132-30 and the NAND circuits 132-211 through 132-240. Each of the outputs of the NAND circuits 132-1 through 132-30 and the NAND circuits 132-211 through 132-240, thus sets to "H" level, and the each gate line of the upper/lower black color display area sets to active state.

In the display period for the black color display area on the other hand, a black level signal is input as the display signal to the horizontal drive system 12. Then, the horizontal switches 122-1 through 122-x sequentially set to the on state in response to horizontal scanning pulses output in sequence from the H scanner 121, and a black level signal is supplied to the signal line of pixel section 11 so that writing of a black level signal is performed all at once for pixels of the upper and lower portions of the black color display area whose gate lines are active.

On entering the display mode for 16:9 just as the case with the display mode for 4:3, vertical scanning is performed in the vertical scanning system 13. However, a black level signal is written for all pixels of the upper/lower black display area, since each output of the NAND circuits 132-1 through 132-30 as well as the NAND circuits 132-211 through 132-240 is set to "H" level by the upper/lower black color display pulse BLK in the display period for the black display area.

Figure 6:
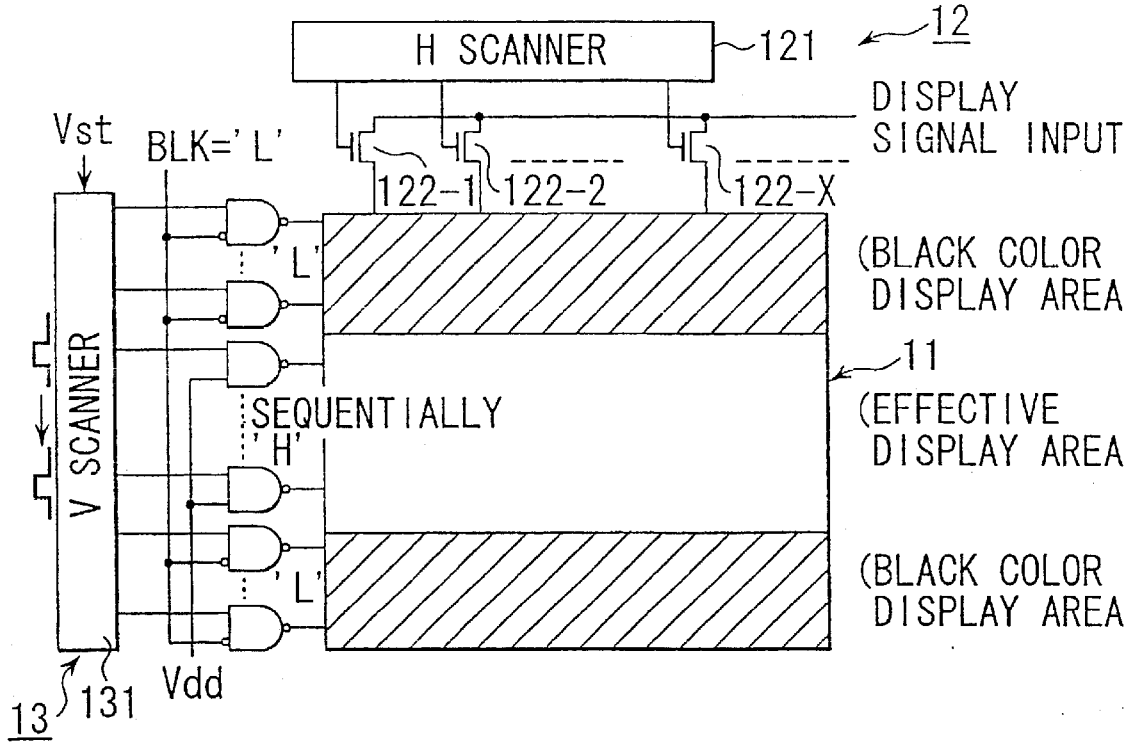
FIG. 6 is a concept diagram illustrating the operation in the effective display area when the display is an aspect ratio 16:9.

The vertical scanning proceeds and on entering the display period for the effective display area, as shown in FIG. 6, the upper/lower black color display pulse BLK is set to "L" level and this level is entered as a negative input to the NAND circuits 132-1 through 132-30 as well as the NAND circuits 132-211 through 132-240. Each output of the NAND circuits 132-1 through 132-30 and NAND circuits 132-211 through 132-240 thus becomes an "L" level, and each gate of the upper/lower black display areas becomes non-active.

Then, in the display period for the effective display area, a power supply voltage Vdd is applied to the inputs of the NAND circuits 132-31 through 132-210 for the applicable display region so that by applying the active "L" vertical scanning pulse sequentially output from the V scanner 131, to the inputs of the NAND circuits 132-31 through 132-210, the outputs of these NAND circuits 132-31 through 132-210 are sequentially set to an "H" level, and each gate line of the effective pixel area is sequentially set to active status.

In the display period for the effective display area however, a normal image signal is input as the display signal to the horizontal drive system 12. In the horizontal drive system 12, at each line selected in sequence by vertical scanning by the vertical scanning system 13, the horizontal switches 122-1 through 122-x sequentially set to the on state in response to horizontal scanning pulses output in sequence from the H scanner 121, and an image signal is supplied to signal line of the pixel section 11.

In this way, dot sequential writing of the image signal is performed for each line in pixels namely from the 31st line to the 210th line of the effective display area. As a result, a black level signal is written in the upper/lower portions of the black color display area of pixel section 11. Since a normal image signal is written in the center section of the pixel section 11 in the effective display area, a display image with a 16:9 aspect ratio is assembled.

As related above, in the active matrix liquid crystal display device of this embodiment, besides addition of a logic control circuit 133 to the vertical drive system 13, a black color display pulse BLK is input from an external source as the control signal for switching the aspect ratio so that only one control terminal is needed for external control allowing the structure to be kept simple, and thus different aspect ratios (here 4:3 and 16:9) can be displayed with a simple design, low cost, and also low power consumption.

The example related in the above embodiment, achieved a logic control circuit 133 by utilizing NAND circuits, however by adjusting the vertical scanning pulse output from the V scanner 131 or the logic (polarity) of the black color display pulse BLK, circuits such as NOR circuits can be utilized to comprise the logic control circuit and achieve the same effect.

Also in the above embodiment, a screen with an aspect ratio of 4:3 was the standard, however a 16:9 aspect ratio can be achieved by implementing a black frame display above and below that screen. For a screen with an aspect ratio of 16:9 as the standard, a logic control circuit the same as on the horizontal drive system 12 side can be added, and by further inputting a black color display pulse BLK, a black frame display can be made on both right and left sides of the screen to achieve a display with a 4:3 aspect ratio. In such a case, the transfer pulse in the H scanner 121 must complete at least one scan cycle in the period that the black color display pulse BLK reaches "H" level, and signal line sampling must be performed with the black level signal as the display signal input.

Further in the above embodiment, different aspect ratios were obtained by writing a black level signal on the upper and lower part of the screen (or left and right) to obtain a black frame display, however, this invention is not limited to a black frame display and may achieve different aspect ratios by writing other luminance levels.

Still further, the example in the above embodiment described a liquid crystal display device utilizing liquid crystal cells as the display element of the pixel however, an active matrix display device such as an electroluminescence display device (EL) utilizing for example EL elements as the display element of the pixel may also be used.

Therefore in the invention as described above, in a display device such as utilizing EL display devices or a liquid crystal display device capable of displaying different aspect ratios; the addition of a control circuit having a simple structure, and controlling the switching of the aspect ratio by applying external control signals, allows a simple structure to be retained while adding just one control terminal so that a display of different aspect ratios can be made, with a simple structure, a low cost and also low electrical power consumption.

What is claimed is:

1. A display device comprising:

a pixel section having pixels arrayed in lines;

a vertical drive system for sequentially setting each pixel of the pixel section by lines to active status;

a control circuit for setting pixels of a specified area on the left and right or upper and lower of the pixel section to active status by applying a control signal; and a horizontal drive system for writing a specified luminance level signal for all pixels of an area set in active status by the control circuit, and also writing for pixels of all other areas, display signals in each line sequentially set to active status by the vertical drive system, wherein:

said control circuit comprises a plurality of two-input gate circuits formed for each line to set each pixel to active status according to output of said gates, each of a specified number of gate circuits corresponding to said specified areas from among said plurality of gate circuits has two inputs for said control signal and vertical scanning signal to scan each pixel in the pixel section in the line direction, and each of said plurality of gate circuits corresponding to areas other than said specified areas has two inputs for a vertical scanning signal for scanning each pixel of said pixel section in the line direction and a signal of a fixed level to pass the vertical scanning signal unchanged.

2. A display device as claimed in claim 1, wherein said specified luminance level signal is a black level signal.

3. A display device as claimed in claim 1, wherein:

the display screen determined by the number of display section pixels essentially has an aspect ratio of 4:3, and the specified number of gate circuits for said specified area is the gate circuits for each line from the first line of said pixel section to the (1/8 of number of vertical pixels) line, and the gate circuits from the (7/8 of number of vertical pixels)+1 line, to the final line.

4. A display device as claimed in claim 3, wherein said control signal is a first level signal to pass said vertical scanning signal unchanged during the display of the 4:3 aspect ratio, and a second level signal to set each pixel in said specified range to active status during display of the 16:9 aspect ratio, and a first level signal to pass said vertical scanning signal unchanged in areas other than said specified area.

5. A display device as claimed in claim 1, wherein said display element of said pixel is a liquid crystal cell.

6. A display device as claimed in claim 1, wherein said display element of said pixel is an electroluminescence element.

7. A drive method for a display device having pixels arrayed in lines, said drive method performing the steps of:

setting pixels of a specified area on the left and right or upper and lower of a pixel section to active status when a control signal is applied, writing a specified luminance level signal all at once for pixels of said specified area set to active status, and for pixels of all other areas, writing display signals in each line of pixels of said pixel section sequentially set to active status, wherein:

a control circuit comprises a plurality of two-input gate circuits formed for each line to set each pixel to active status according to output of said gates, each of a specified number of gate circuits corresponding to said specified areas from among said plurality of gate circuits has two inputs for said control signal and vertical scanning signal to scan each pixel in the pixel section in the line direction, and each of said plurality of gate circuits corresponding to areas other than said specified areas has two inputs for a vertical scanning signal for scanning each pixel of said pixel section in the line direction and a signal of a fixed level to pass the vertical scanning signal unchanged.

8. A display device comprising:

a first drive system, said first drive system generating a plurality of first scanning pulses;

a control circuit, said control circuit including a plurality of control circuit devices, an effective display circuit device of said plurality of control circuit devices receiving an effective display scanning pulse from said first drive system, said effective display scanning pulse being a scanning pulse of said plurality of first scanning pulses, said effective display circuit device transferring said received effective display scanning pulse to an effective display pixel, a frame display circuit device of said plurality of control circuit devices receiving a frame display scanning pulse from said first drive system as a received frame display scanning pulse, said frame display circuit device receiving a control signal, said frame display scanning pulse being another scanning pulse of said plurality of first scanning pulses, said frame display circuit device transferring said received frame display scanning pulse to a frame display pixel when transfer of said received frame display scanning pulse to said frame display pixel is uninhibited by said frame display circuit device, said control signal controlling said frame display circuit device to inhibit transfer of said received frame display scanning pulse to said frame display pixel.

9. A display device as claimed in claim 8, wherein said frame display circuit device inhibits transfer of said received frame display scanning pulse to said frame display pixel.

10. A display device as claimed in claim 8, wherein said plurality of control circuit devices are NAND gates.

11. A display device as claimed in claim 8, wherein said plurality of control circuit devices are NOR gates.

12. A display device as claimed in claim 8, wherein said display element of said pixel is a liquid crystal cell.

13. A display device as claimed in claim 8, wherein said display element of said pixel is an electroluminescence element.

14. A display device as claimed in claim 8, wherein said effective display circuit device transfers said received effective display scanning pulse to said effective display pixel.

15. A display device as claimed in claim 8, further comprising a pixel section, said pixel section having a plurality of pixels, said plurality of pixels including said effective display pixel and said frame display pixel.

16. A display device as claimed in claim 15, further comprising:

a display, said display including said plurality of pixels, said plurality of pixels including a plurality of frame display pixels, each of which receiving one of said plurality of first scanning pulses when said display is displaying an image with a standard mode aspect ratio or a wide mode aspect ratio, said plurality of pixels further including a plurality of effective display pixels, each of which receiving different ones of said plurality of first scanning pulses when said display is displaying said image with a wide mode aspect ratio, but not receiving said different ones of said plurality of first scanning pulses when said display is displaying said image with a standard mode aspect ratio.

17. A display device as claimed in claim 15, further comprising:

a display, said display including said plurality of pixels, said plurality of pixels including a plurality of frame display pixels, each of which receiving one of said plurality of first scanning pulses when said display is displaying an image with a standard mode aspect ratio or a wide mode aspect ratio, said plurality of pixels further including a plurality of effective display pixels, each of which receiving different ones of said plurality of first scanning pulses when said display is displaying said image with a standard mode aspect ratio, but not receiving said different ones of said plurality of first scanning pulses when said display is displaying said image with a wide mode aspect ratio.

18. A display device as claimed in claim 15, further comprising a second drive system, said second drive system generating a plurality of second scanning pulses.

19. A display device as claimed in claim 18, wherein:

said effective display scanning pulse is applied to a gate of said effective display pixel and a second scanning pulse of said plurality of second scanning pulses is applied to a source/drain of said effective display pixel, said frame display scanning pulse is applied to a gate of said frame display pixel and said second scanning pulse is applied to a source/drain of said frame display pixel.

20. A display device as claimed in claim 19, wherein said second scanning pulse provides a specified luminance level signal for said frame display pixel.

21. A display device as claimed in claim 20, said specified luminance level signal is a black level signal.

22. A display device as claimed in claim 18, wherein:

a second scanning pulse of said plurality of second scanning pulses is applied to a gate of said effective display pixel and said effective display pulse is applied to a source/drain of said effective display pixel, another second scanning pulse of said plurality of second scanning pulses is applied to a gate of said frame display pixel and said frame scanning pulse is applied to a source/drain of said frame display pixel.

23. A display device as claimed in claim 22, wherein said frame scanning pulse provides a specified luminance level signal for said frame display pixel.

24. A display device as claimed in claim 23, said specified luminance level signal is a black level signal.

* * * * *